US005486740A

United States Patent [19]

Yamashita et al.

[11] Patent Number: 5,486,740

[45] Date of Patent: Jan. 23, 1996

[54] LIGHTING CIRCUIT FOR VEHICULAR DISCHARGE LAMP HAVING DC/AC CONVERTER

[75] Inventors: Masayasu Yamashita; Atsushi Toda, both of Shimizu, Japan

[73] Assignee: Koito Manufacturing Co., Ltd., Tokyo, Japan

[21] Appl. No.: 346,918

[22] Filed: Nov. 23, 1994

[30] Foreign Application Priority Data

Nov. 30, 1993 [JP] Japan ..... 5-323297

[51] Int. Cl.[6] ..... G05F 1/00

[52] U.S. Cl. ..... 315/308; 315/307; 315/291; 315/82; 315/DIG. 5; 315/DIG. 7

[58] Field of Search ..... 315/308, 307, 315/291, 224, 127, 128, 82, 77, 83, 226, 209 R, DIG. 5, DIG. 7

[56] References Cited

U.S. PATENT DOCUMENTS

| | | | |
|---|---|---|---|
| 4,240,009 | 12/1980 | Paul | 315/224 |
| 4,724,360 | 2/1988 | Luursema | 315/244 |
| 5,049,790 | 9/1991 | Herfurth et al. | 315/291 |
| 5,097,181 | 5/1992 | Kakitani | 315/209 |
| 5,140,229 | 8/1992 | Yagi et al. | 315/307 |
| 5,142,203 | 8/1992 | Oda et al. | 315/308 |
| 5,151,631 | 9/1992 | Oda et al. | 315/308 |
| 5,212,428 | 5/1993 | Sasaki et al. | 315/308 |
| 5,295,036 | 3/1994 | Yagi et al. | 361/79 |
| 5,365,152 | 11/1994 | Ozawa et al. | 315/291 |
| 5,404,082 | 4/1995 | Hernandez et al. | 315/219 |
| 5,406,471 | 4/1995 | Yamanaka | 363/124 |

*Primary Examiner*—Robert J. Pascal
*Assistant Examiner*—Haissa Philogene
*Attorney, Agent, or Firm*—Sughrue, Mion, Zinn, Macpeak & Seas

[57] ABSTRACT

A lighting circuit reduces the chance of shifting the generation timing for a start pulse with respect to the polarity of a rectangular wave. The lighting circuit has a start pulse generator which is designed to generate a start pulse only when the rectangular wave voltage obtained by a DC-AC converter has a certain polarity. A lighting discriminating circuit discriminates the ON status or OFF status of a discharge lamp. A lighting frequency controller is provided to alter the lighting frequency so that the frequency of the rectangular wave output from the DC-AC converter when the OFF status of the discharge lamp is discriminated becomes lower than the frequency of the rectangular wave output from the DC-AC converter when the ON status of the discharge lamp is discriminated.

14 Claims, 13 Drawing Sheets

30A
42
42'
43
43
So (42)
So (42')
44
44'
So (36)
S̄o (36)
36
Q
Q̄
D
CK
So (35)
S̄o (35)
35
S
R
S(34)
34
OSCILLATOR
38
40
39
41
37
Counter
Q8
CK
So (37)
LIGHTING DISCRIMINATION SIGNAL
S(27)

LIGHTING CIRCUIT FOR VEHICULAR DISCHARGE LAMP HAVING DC/AC CONVERTER

BACKGROUND OF THE INVENTION

1. Field of the Invention

The present invention generally relates to a novel lighting circuit for a vehicular discharge lamp. More particularly, this invention pertains to a novel lighting circuit for a vehicular discharge lamp, that executes timing control in such a way as to generate a start pulse to the discharge lamp which has a correlation with the polarity of a rectangular wave pulse supplied to the discharge lamp and that can suppress the probability of deviation in the generation timing for the start pulse.

2. Description of the Related Art

To turn on a high-voltage discharge lamp, such as a metal halide lamp, it is necessary to generate a start pulse and supply it to the discharge lamp.

FIG. 14 shows an example of the structure of a conventional lighting circuit.

The lighting circuit a has a bridge circuit c which converts a DC voltage from a DC power supply circuit b to a rectangular wave voltage, and a start pulse generator d which generates a start pulse. The start pulse from the start pulse generator d is superimposed on the rectangular wave output from the bridge circuit c, and the resultant pulse is applied to a discharge lamp to activate the lamp.

The start pulse generator d has a power supply e, a transformer f, a switch element g, and a capacitor h, as shown in FIG. 15. When the terminal voltage of the capacitor h reaches a predetermined level, the switch element g is set on and the pulse generated then is boosted by the transformer f. The boosted pulse is superimposed on the output (rectangular wave) of the bridge circuit c and the resultant pulse is then applied to a discharge lamp i.

The bridge circuit c, though its detailed illustration is omitted, is so designed as to alternately switch two pairs of semiconductor switch elements to yield an AC output.

It is known that the easiness of the transition from the glow discharge of the discharge lamp i to the arc discharge varies depending on the phase relationship between the voltage direction of the start pulse and the polarity of the rectangular wave output from the bridge circuit c. Suppose that "V(1)" denotes the output voltage associated with one (j) of two power supply lines j and j', connecting the output terminals of the bridge circuit c to the power receiving terminals of the discharge lamp i, where the secondary winding of the transformer f is provided, and "V(2)" denotes the output voltage associated with the other power supply line j' as shown in FIG. 15. Then the lighting characteristic of the discharge lamp becomes better if the start pulse is generated in the direction indicated by an arrow A in FIG. 15 when the output voltage V(1) has a low level and the output voltage V(2) has a high level.

There are two possible ways to generate the start pulse at such a timing. The first method is to provide a switch element having a trigger terminal and its control circuit and to execute synchronous control in such a way that the switch element g is set on only when V(2) is at a high level. The second method is to use a self-breakdown switch element, such as a spark gap, for the switch element g so that the capacitor is charged only in a specific phase of the rectangular wave.

The former method however requires a high-breakdown switch element and its driving circuit and/or control circuit, thus complicating the circuit structure. In this respect, the latter method is practically used and may employ a circuit structure as shown in FIG. 16.

A start pulse generator k has a constant power supply circuit l, a transformer m, a self-breakdown switch element n and a capacitor o.

The primary winding and the secondary winding of the transformer m are wound in the opposite phases, with the secondary winding connected to one (j) of the power supply lines j and j' which connect the output terminals of the bridge circuit c to the power receiving terminals of the discharge lamp i. The primary winding of the transformer m has a winding-start end connected to one end of the self-breakdown switch element n and also connected to the winding-termination end of the secondary winding of the transformer m. The winding-termination end of the primary winding is connected via the capacitor o to the other end of the self-breakdown switch element n.

The constant power supply 1 has a positive terminal connected between the self-breakdown switch element n and the capacitor o via a resistor p and a forward biased diode q, and the other terminal connected to the power supply line j'.

Given that "v" denotes the amplitude of the rectangular wave from the bridge circuit c and "el" denotes the voltage from the constant power supply I, the charge voltage to the capacitor o becomes "el−v" when the voltage v(1) associated with the power supply line j is at a high level and becomes "el+v" when the voltage v(2) associated with the power supply line j' is at a high level. That is, the charge voltage varies by the phase of the rectangular wave.

When the self-breakdown switch element n is designed to yield with the voltage el, the terminal voltage Vc of the capacitor o rises only in the high-level duration of V(2) as shown in FIG. 17 and the self-breakdown switch element n yields only in that period. The pulse generated at this time is boosted by the transformer m and the boosted pulse is superimposed on the rectangular wave output frown the bridge circuit c. The resultant pulse is then applied to the discharge lamp i.

The self-breakdown switch element does not yield immediately when the terminal voltage of the capacitor reaches a predetermined level, but functions with a certain delay time. This affects the relationship between the timing of generating the start pulse and the phase of the rectangular wave, so that the start pulse generator may not be generated at the given timing.

While it is ideal that the self-breakdown switch element n should yield at a time ta when the terminal voltage of the capacitor o reaches el as shown in FIG. 17, the switch element n may actually yield at a time tb with a delay t from the time ta and the time tb may be shifted into the next half cycle (where V(1) is at a high level). In this case, it may not be possible to generate the start pulse when V(2) has a high level, disadvantageously.

SUMMARY OF THE INVENTION

Accordingly, it is an object of the present invention to provide a lighting circuit for a vehicular discharge lamp, which can overcome the above shortcoming.

To achieve the object, according to the present invention, there is provided a lighting circuit for a vehicular discharge lamp, which comprises a DC-AC converter for converting a DC voltage from a DC power supply circuit to an AC voltage with a rectangular waveform and supplying the AC voltage to a discharge lamp; a start pulse generator for generating a start pulse to the discharge lamp, superimposing the start pulse on an output of the DC-AC converter and supplying a resultant pulse to the discharge lamp, the start pulse generator including a transformer having a secondary winding connected to a power supply line connecting an output terminal of the DC-AC converter to the discharge lamp and a primary winding to which a capacitor and a self-breakdown switch element are connected in series, whereby a timing at which the start pulse is generated by closing of the series circuit of the self-breakdown switch element, the primary winding and the capacitor, caused when the self-breakdown switch element yields, is associated with a specific phase of the rectangular wave from the DC-AC converter; a lighting discriminating circuit for discriminating an 0N status or OFF status of the discharge lamp; and lighting frequency control means for changing a frequency of the rectangular wave from the DC-AC converter in such a manner that a frequency of the rectangular wave output from the DC-AC converter at a time the OFF status of the discharge lamp is discriminated by the lighting discriminating circuit becomes lower than a frequency of the rectangular wave at a time the ON status of the discharge lamp is discriminated by the lighting discriminating circuit.

According to the present invention, the ON status or the OFF status of the discharge lamp is discriminated, and the lighting frequency is changed in such a manner that the frequency of the rectangular wave output from the DC-AC converter before the discharge lamp has been turned on becomes lower than the frequency of the rectangular wave after the discharge lamp has been turned on, thereby reducing the ratio of the delay time of the self-breakdown switch element to the half cycle of the rectangular wave. This reduces the chance of affecting the relationship between the generation timing for the start pulse and the phase of the rectangular wave.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIGS. 5A and 5B are diagrams showing specific examples of the start pulse generator, FIG. 5A showing an example where a constant power supply is constituted by providing a start winding on the secondary winding side of a transformer of a DC booster circuit while FIG. 5B shows an example where the constant power supply is constituted by using a voltage doubler rectifier circuit;

FIGS. 8A and 8B are diagrams for explaining the relationship between the lighting frequency and the generation timing for the start pulse, FIG. 8A showing the rise of the terminal voltage of a capacitor when the lighting frequency is high while FIG. 8B shows the rise of the terminal voltage of the capacitor when the lighting frequency is low;

DETAILED DESCRIPTION OF THE PREFERRED EMBODIMENT

A preferred embodiment of a lighting circuit for a vehicular discharge lamp according to the present invention will be described below in detail with reference to the accompanying drawings. The illustrated embodiment is the present invention adapted for a lighting circuit for a vehicular metal halide lamp.

Figure 1:
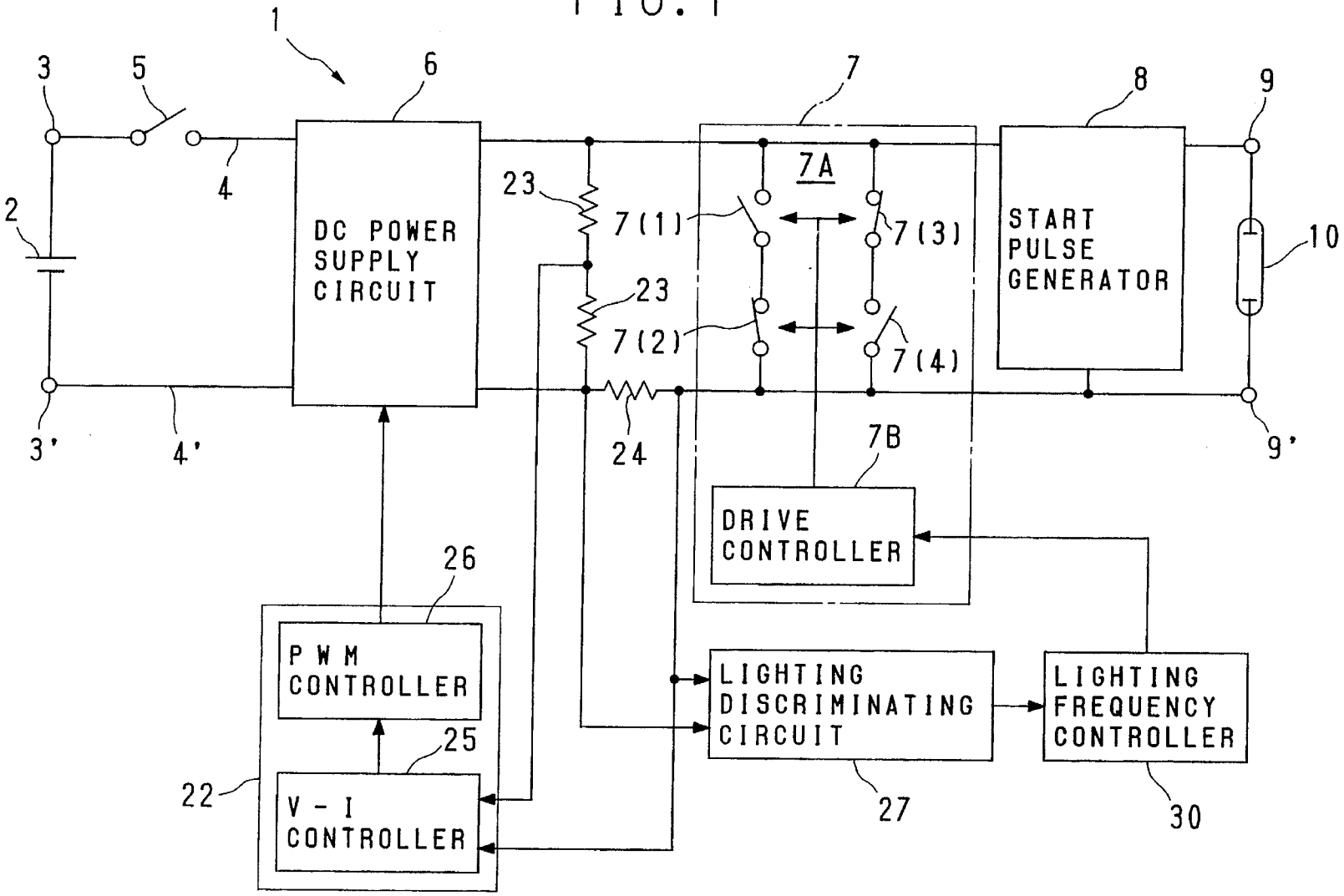
FIG. 1 is a circuit diagram illustrating the structure of a lighting circuit for a vehicular discharge lamp according to the present invention.

FIG. 1 schematically shows the structure of a lighting circuit 1. The lighting circuit 1 has a battery 2, connected between DC voltage input terminals 3 and 3', a lighting switch 5, a DC power supply circuit 6, a DC-AC converter 7, a start pulse generator 8, a control circuit 22, a lighting discriminating circuit 27 and a lighting frequency controller 30.

Reference numerals 4 and 4' denote DC power supply lines. The lighting switch 5 is inserted in the positive line 4.

The DC power supply circuit 6 is provided to boost a battery voltage supplied via the lighting switch 5. This DC power supply circuit 6 may take the structure of a chopper type DC-DC converter and executes the boosting operation under the control of the control circuit 22 which will be described in detail later. It should be noted that although the battery voltage is boosted by the DC power supply circuit 6 in this embodiment, the circuit is designed to reduce the battery voltage when it is high.

The DC-AC converter 7 is provided at the subsequent stage of the DC power supply circuit 6 to convert the DC voltage from the DC power supply circuit 6 into an AC voltage of a rectangular waveform.

This DC-AC converter 7 comprises a bridge circuit 7A having semiconductor switch elements 7i (i= 1, 2, 3 and 4), represented by switch symbols, and a drive controller 7B which controls the driving of the switch elements 7i. The semiconductor switch elements 7(1) and 7(4) make a pair, and the semiconductor switch elements 7(2) and 7(3) make a pair, so that those pairs of switch elements are switched reciprocally by a control signal sent from the drive controller 7B. The specific structures of the bridge circuit 7A and the drive controller 7B will be discussed later.

The start pulse generator 8 is provided at the subsequent stage of the DC-AC converter 7. The start pulse generator 8 generates a start pulse to a metal halide lamp 10 having rated power of 35 W, connected between AC output terminals 9 and 9' of the start pulse generator 8, and superimposes the start pulse on the rectangular wave from the DC-AC converter 7. The resultant pulse is supplied to the metal halide lamp 10.

Figure 4:
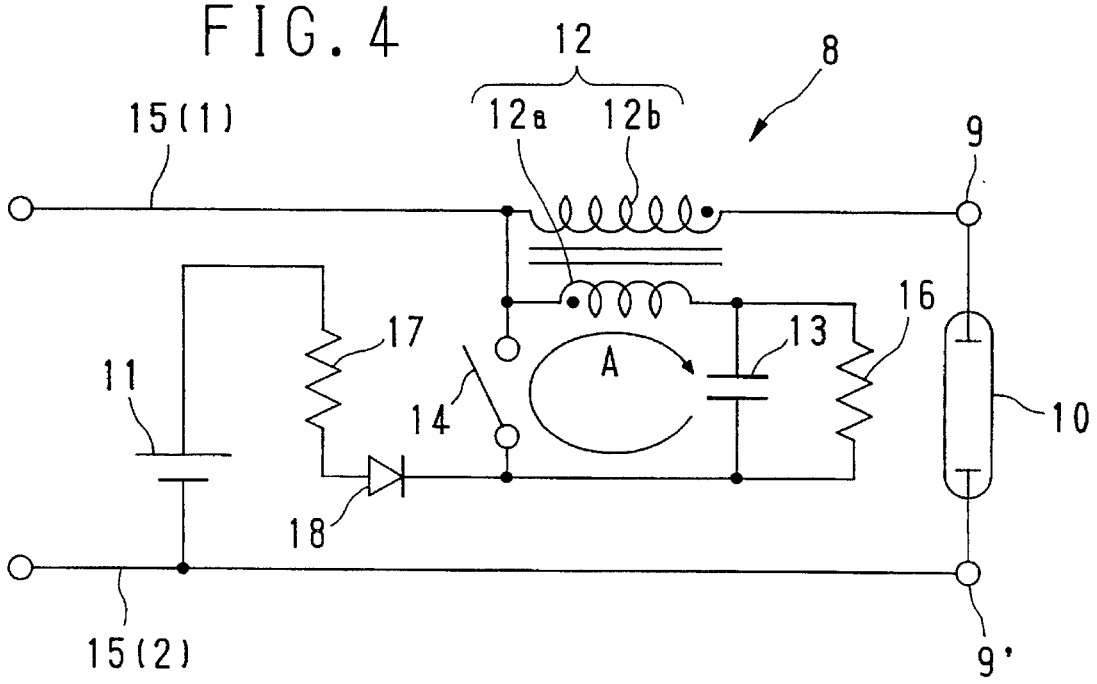
FIG. 4 is a circuit diagram showing the basic structure of a start pulse generator.

FIG. 4 shows the basic structure of the start pulse generator 8, which has a constant power supply 11, a transformer 12, a capacitor 13 and a self-breakdown switch element 14 (represented by a switch symbol in the diagram).

The transformer 12 has a primary winding **12*a* and a secondary winding 12*b* wound in the opposite phases. The secondary winding 12*b* is connected to a power supply line 15(1) which connects one of the output terminals of the DC-AC converter 7 to the AC output terminal 9. The primary winding 12*a* has one end connected to the end of the secondary winding 12*b* which is located on the opposite side to the metal halide lamp 10 and also connected to one end of the self-breakdown switch element 14. The other end of the primary winding 12*a* is connected to the other end of the stir-breakdown switch element 14 via a parallel circuit of the capacitor 13 and a resistor 16**.

The capacitor 13 is charged via the line which extends from the constant power supply 11 to the capacitor 13 passing through a resistor 17 and a diode 18. That is, the positive terminal of the constant power supply 11 is connected via the resistor 17 to the anode of the diode 18 whose cathode is connected between the self-breakdown switch element 14 and the capacitor 13. The negative terminal of the constant power supply 11 is connected to a power supply line 15(2) connecting the output terminal of the DC-AC converter 7 to the power supply terminal 9'.

Figure 5A:
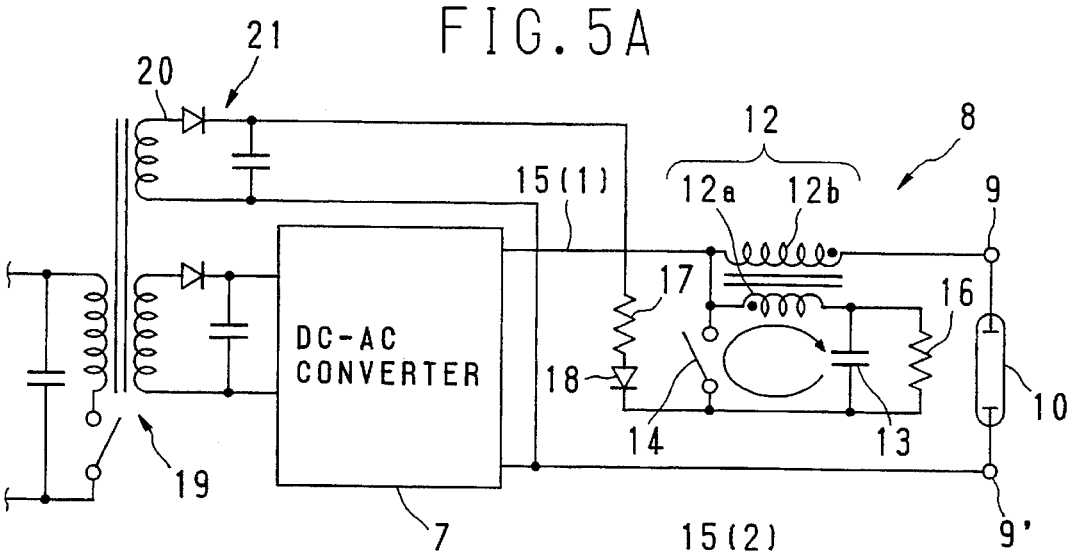
Figure 5B:
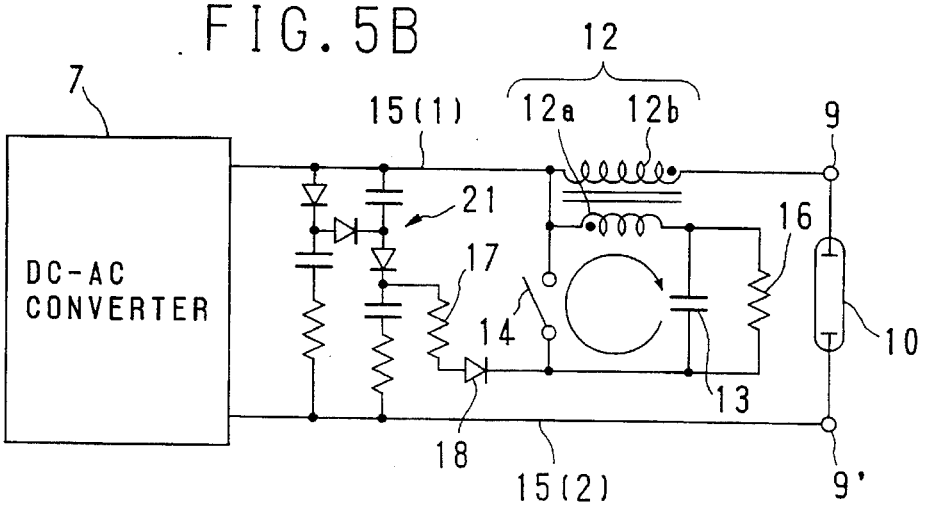

The constant power supply 11 may be accomplished by designing the DC power supply circuit 6 to have the structure of a flyback type DC-DC converter with a start winding 20 provided on the secondary winding side of its transformer 19 and by rectifying the output from the start winding 20 by a rectifier 21, provided at the subsequent stage of the start winding 20, as shown in FIG. 5A, thus yielding a constant voltage. Alternatively, the constant power supply 11 may be accomplished by providing a voltage doubler rectifier circuit 21, comprising diodes, capacitors and resistors, between the power supply lines 15(1) and 15(2), as shown in FIG. 5B, thus yielding a constant voltage.

When the terminal voltage of the capacitor 13, which is charged by the constant power supply 11 in the start pulse generator 8, reaches a predetermined value, the pulse that is generated by the yielding of the self-breakdown switch element 14 is boosted by the transformer 12 and is superimposed on the rectangular wave. It is to be noted that this start pulse is generated only when the voltage associated with the power supply line 15(2) has a high level.

The control circuit 22 in FIG. 1 serves to control the output voltage of the DC power supply circuit 6. The control circuit 22 receives a voltage detection signal corresponding to the output voltage of the DC power supply circuit 6, which is detected by a pair of voltage detecting resistors 23, provided between the output terminals of the DC power supply circuit 6.

A current detecting resistor 24, inserted in the ground line connecting the DC power supply circuit 6 to the DC-AC converter 7 converts a current detection signal corresponding to the output current of the DC power supply circuit 6 into a voltage. The control circuit 22 receives this converted voltage.

Incidentally, although signals corresponding to the lamp voltage and lamp current of the metal halide lamp 10 are acquired from the output stage of the DC power supply circuit 6 in this embodiment, the circuit structure may of course be modified to detect those signals directly.

The control circuit 22 generates a control signal according to these detection signals, and sends the control signal to the DC power supply circuit 6 to control the output voltage of the circuit 6, thereby performing power control matching with the activation status of the metal halide lamp 10. Accordingly, the control circuit 22 can shorten the time of activating the lamp 10 or the time of reactivating the lamp 10 to ensure quick transition to the steady power control. The control circuit 22 includes a V (Voltage)-I (Current) controller 25, and a PWM (Pulse Width Modulation) controller 26.

The V-I controller 25 is designed to perform lighting control of the metal halide lamp 10 based on a predetermined control curve. When receiving the detection signal from the voltage detecting resistor pair 23, which is associated with the output voltage of the DC power supply circuit 6, the V-I controller 25 computes a current instructing value corresponding to the detection signal, compares this value with the current value detected by the current detecting resistor 24, and sends an instruction signal to the PWM controller 26.

The PWM controller 26 produces a signal whose pulse width varies in accordance with the instruction signal from the V-I controller 25, and sends out this signal as a control signal for the semiconductor switch elements (not shown) in the DC power supply circuit 6.

The light discriminating circuit 27 discriminates the ON status or the OFF status of the metal halide lamp 10 depending on whether the detection current for the lamp current, detected by the current detecting resistor 24, is equal to or greater than a predetermined reference value.

Figure 2:
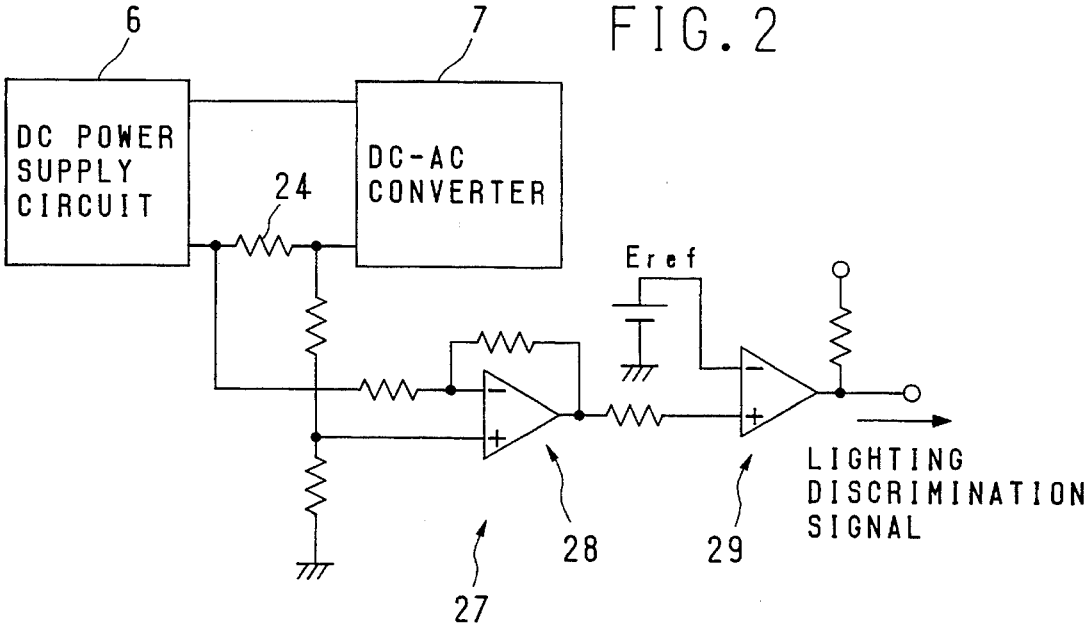
FIG. 2 is a circuit diagram showing an example of the structure of a lighting discriminating circuit.

FIG. 2 shows an example of the structure of the light discriminating circuit 27 designed to provide a binary output signal by comparing the amplified terminal voltage of the current detecting resistor 24 with a predetermined reference voltage.

To describe in detail, the terminal voltage of the current detecting resistor 24 is input to an amplifier 28 whose amplified output is compared with a reference voltage Eref by a comparator 29. When the amplified output is greater than the reference voltage Eref, it is discriminated that the metal halide lamp 10 is in the ON status and an H (High) signal is output as a lighting discrimination signal. When the amplified output is equal to or smaller than the reference voltage Eref, it is discriminated that the metal halide lamp 10 is in the OFF status and an L (Low) signal is output as the lighting discrimination signal. The lighting discrimination signal is sent to the lighting frequency controller 30 located at the subsequent stage of the light discriminating circuit 27. As illustrated, the amplifier 28 has the structure of an inversion amplifier using an operational amplifier, with one end of the current detecting resistor 24 connected via a resistor to the inversion input terminal of the operational amplifier and the other end of the resistor 24 connected via a voltage dividing resistor to the non-inversion input terminal of the operational amplifier.

The lighting frequency controller 30 sets the frequency of the rectangular wave to a low value before the activation of the metal halide lamp 10 and sets the frequency of the rectangular wave to a high value after the activation. The lighting frequency controller 30 executes frequency control in accordance with the aforementioned lighting discrimination signal.

Figure 3:
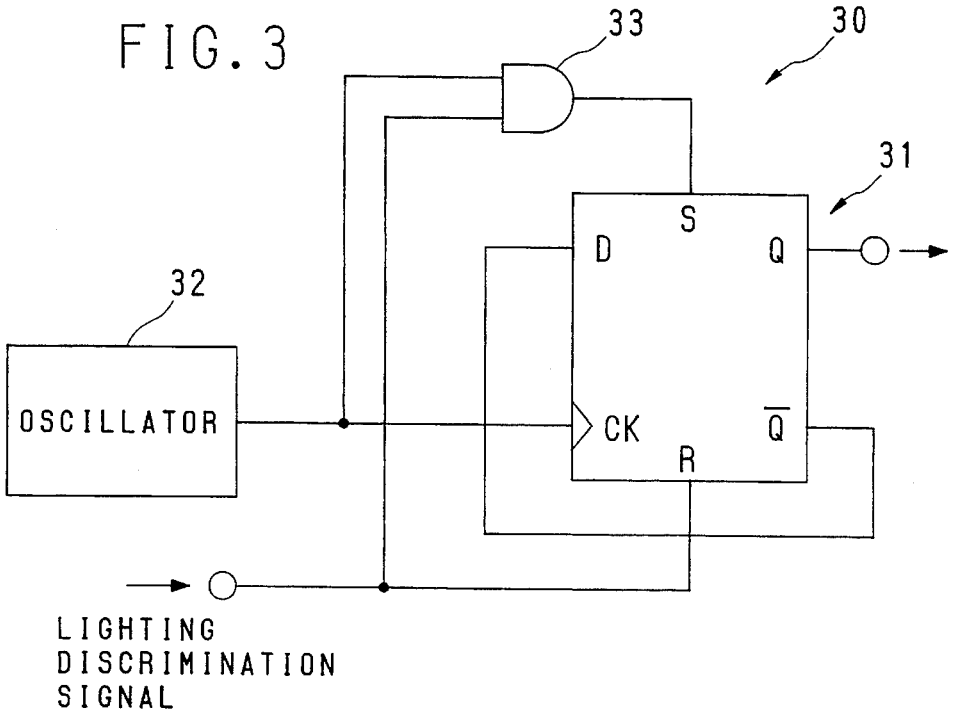
FIG. 3 is a circuit diagram exemplifying the structure of a lighting frequency controller.

FIG. 3 shows the basic structure of the lighting frequency controller 30 which employs a set and reset type flip-flop 31.

A reference clock signal (having a reference frequency "f1") from an oscillator 32 is input to a clock input terminal (CK) of the flip-flop 31. The reference clock signal and the aforementioned lighting discrimination signal are supplied via an AND gate 33 to the set terminal (S) of the flip-flop 31. The lighting discrimination signal is also supplied to the reset terminal (R) of the flip-flop 31.

The output signal from the terminal Q of the flip-flop 31 is sent to the aforementioned drive controller 7B to be used as a switching control signal for FETs. The output signal from the terminal $\overline{Q}$ of the flip-flop 31 is sent to the input terminal D.

Figure 6:
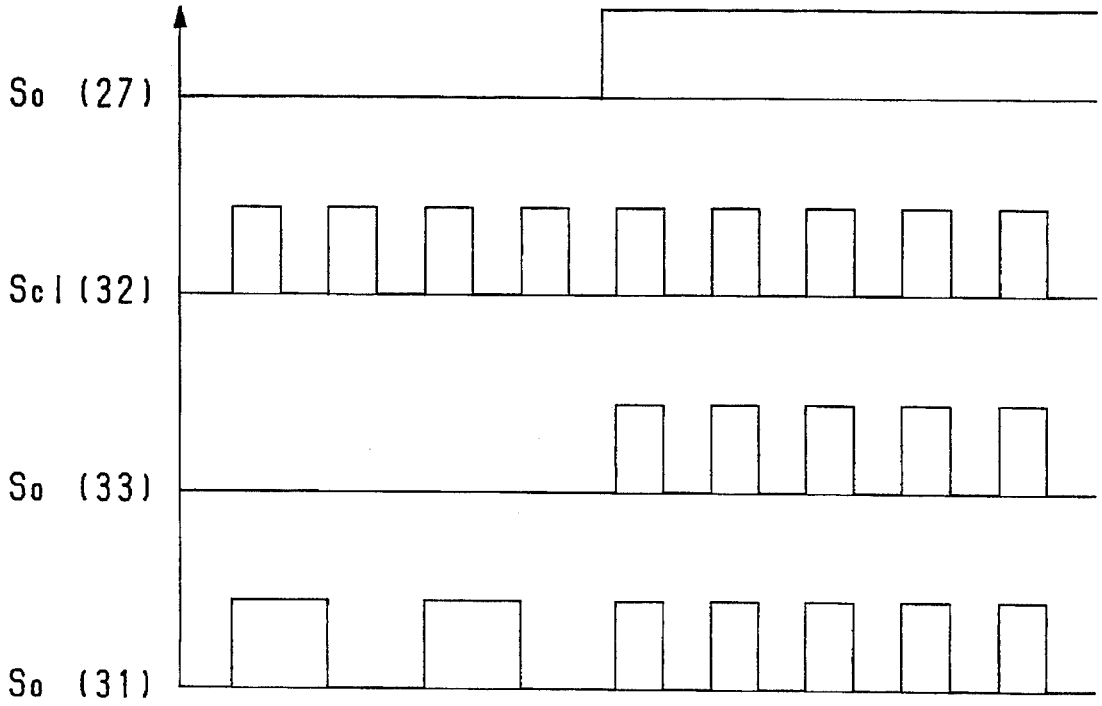
FIG. 6 is a time chart for explaining the operation of the lighting frequency controller in FIG. 3.

FIG. 6 is a time chart for explaining the operation of the lighting frequency controller 30. In the diagram, "So(27)" denotes the lighting discrimination signal, "Scl(32)" denotes the reference clock signal, "So(33)" denotes the output signal of the AND gate 33, and "So(31)" denotes the Q output signal of the flip-flop 31.

When it is determined that the lighting discrimination signal So(27) has an L level, i.e., that the lamp 10 is deactivated, the L-level signal is applied to the reset terminal of the flip-flop 31. Consequently, the Q output signal So(31) of the flip-flop 31 is a signal obtained by frequency-dividing the reference clock signal by 2 (given that "f2" is the reference frequency, f2=½).

When it is determined that the lighting discrimination signal So(27) has an H level, i.e., that the lamp 10 is activated, the H-level signal is applied to the reset terminal of the flip-flop 31. Consequently, the flip-flop 31 is set in synchronism with the reference clock signal so that the reference clock signal is output as the Q output signal So(31) of the flip-flop 31.

It is apparent from the above that the lighting frequency controller 30 outputs a rectangular wave signal having the reference frequency f2(<f1) before the lamp 10 is activated, and outputs a rectangular wave signal having the reference frequency f1 after the activation of the lamp 10. This scheme is employed to prevent the relationship between the phase of the rectangular wave voltage supplied to the lamp 10 and the generation timing for the start pulse as much as possible.

As described above, the generation timing for the start pulse in the lighting circuit 1 has a certain correlation with the polarity of the rectangular wave supplied to the lamp 10. It has been proved that when the start pulse generated has a positive potential as indicated by an arrow A in FIG. 4, the transition from the glow discharge to the arc discharge becomes easier in the case where the voltage V(2) on the power supply line 15(2) has a high level (the voltage V(1) on the power supply line 15(1) has a low level) rather than the case where the start pulse has the opposite phase. Based on this knowledge, the lighting circuit 1 is designed in such a manner as to increase the probability of generating the start pulse in the H-level duration of V(2).

Figure 7:
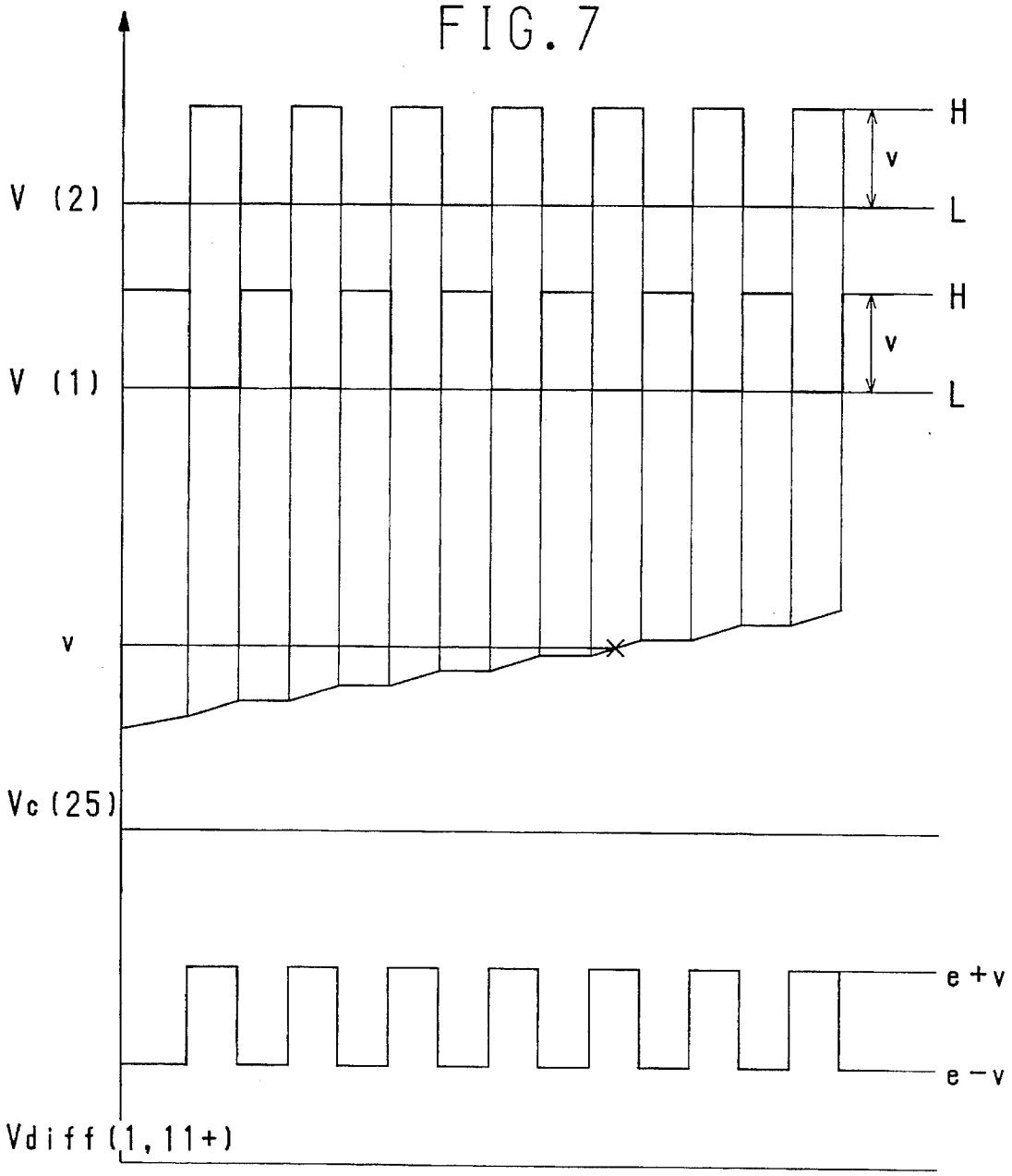
FIG. 7 is a time chart for explaining the operation of the start pulse generator.

FIG. 7 is a time chart for explaining the generation of the start pulse. In the diagram, "V(2)" denotes the output voltage associated with the power supply line 15(2), "V(1)" denotes the output voltage associated with the power supply line 15(1), "Vc(25)" denotes the terminal voltage of the capacitor 13 and "Vdiff(1, 11+)" denotes the potential difference between the power supply line 15(1) and the positive terminal of the constant power supply 11.

As illustrated, V(2) and V(1), both being rectangular wave outputs, have the opposite phases with an amplitude v.

Given that the voltage from the constant power supply 11 is e (>v), the terminal voltage Vc(25) of the capacitor 13 rises to the maximum voltage e+v with a time constant determined by the capacitance of the capacitor 13 and the resistance of the resistor 16. However, the capacitor 13 is charged only in the period where V(2) is at a high level when the terminal voltage Vc(25) approaches the voltage e, and no charging of the capacitor 13 is conducted while V(2) is at a low level.

In other words, the potential difference, Vdiff(1, 11+), between the positive terminal of the constant power supply 11 and the power supply line 15(1) has a rectangular waveform, which has a peak of e+v during the high-level duration of V(2), and a bottom value of e−v during the low-level duration of V(2). After the terminal voltage of the capacitor 13 exceeds e−v, the capacitor 13 is charged only in the high-level duration of V(2) and the terminal voltage of the capacitor 13 gradually rises.

By selecting the self-breakdown switch element 14 which yields with the voltage v, theoretically, the terminal voltage Vc(25) of the capacitor 13 exceeds the voltage v at the point marked with "x" in FIG. 7 so that the start pulse is generated, and this timing is limited within the H-level duration of V(2).

Due to the delayed yielding of the self-breakdown switch element 14, however, the timing at which the start pulse is actually generated may be delayed, switching the polarity of the rectangular wave, so that the start pulse is generated in the L-level duration of V(2).

Figure 8A:
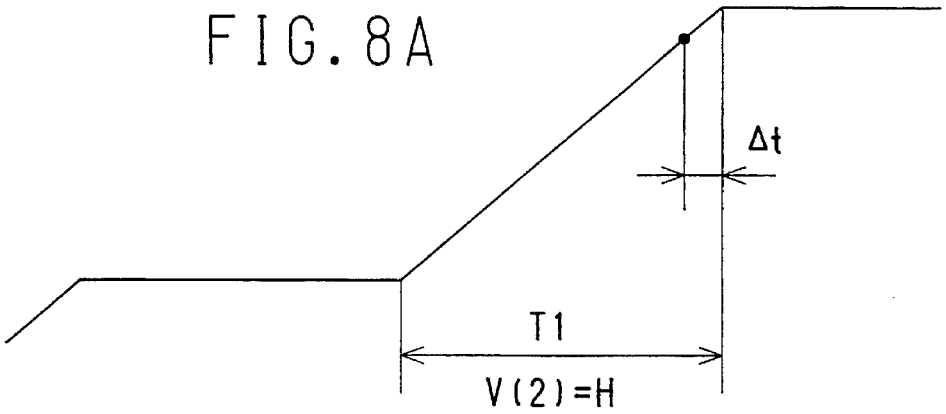
Figure 8B:
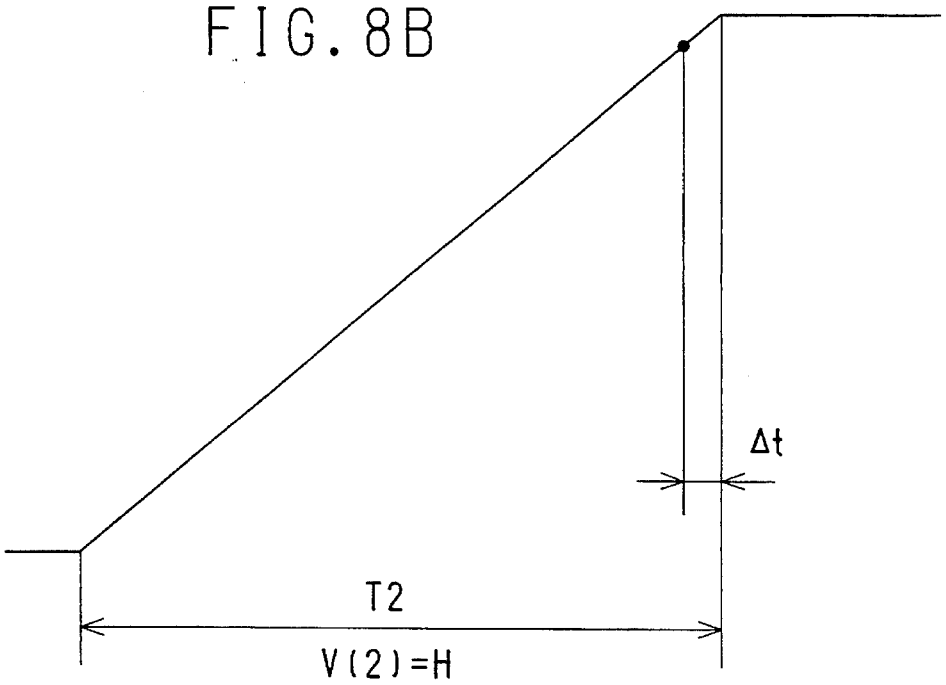

FIGS. 8A and 8B illustrate the relationship between the lighting frequency and the generation timing for the start pulse. FIG. 8A shows the case (F1) where the lighting frequency is high while FIG. 8B shows the case (F2) where the lighting frequency is low.

Given that the delay of the yielding of the self-breakdown switch element 14 is t, the probability that the generation timing for the start pulse comes off the H-level duration of V(2) is proportional to the lighting frequency.

In other words, given that the period corresponding to the lighting frequency F1 is "2•T1", the probability that the start pulse is generated within the period T1 where V(2) has a high level becomes (T1−Δt)/T1 as apparent from FIG. 8A. This is because the generation timing for the start pulse is limited to the period starting from the beginning of the period T1 where V(2) has a high level to the point earlier by At than the end point of the period T1.

When the lighting frequency is low, given that the period corresponding to the lighting frequency F2 is "2•T2", the probability that the start pulse is generated within the H-level duration T1 of V(2) becomes (T2−Δt)/T2 as apparent from FIG. 8B.

As T1<T2, therefore, (T1−Δt)/T1<(T2−Δt)/T2 is derived.

The probability that the generation Timing for the start pulse comes off the H-level duration of V(2) is Δt/T1 in the case shown in FIG. 8A and it is Δt/T2 in the case shown in FIG. 8B. Thus, the above equation can be rewritten as $\Delta t/T1>\Delta t/T2$. That is, due to the inverse proportional relation between the cycle and the frequency, the probability that the generation timing for the start pulse comes off the H-level duration of V(2) is proportional to the lighting frequency.

More specifically, given that $\Delta t$ is 0.1 ms, F1=500 Hz (T1=1 ms) and F2=250 Hz (T2= 2 ms), $\Delta t/T1=0.1$ and $\Delta t/T2=0.05$ so that the probability that the generation timing for the start pulse comes off the H-level duration of V(2) becomes 10% and 5%, respectively.

Since one may consider that the reference frequency f2 of the rectangular wave before the activation of the lamp corresponds to the aforementioned F2 and the reference frequency f1 of the rectangular wave after the activation of the lamp corresponds to the aforementioned F1 in the above-described lighting frequency controller 30, the probability that the generation timing for the start pulse comes off the H-level duration of V(2) becomes smaller before the activation of the lamp.

Once the lamp is turned on, it is unnecessary to generate the start pulse so that the bridge circuit 7A should be controlled with the frequency f1 at which the lighting stability becomes better.

Meanwhile, the lighting state is unstable for a little while after the metal halide lamp 10 is turned on. If the lamp current tries to pass the zero-crossing point during that time, the polarity may not be inverted and the value of the lamp current may become zero, causing the lighting failure of the metal halide lamp 10.

Figure 9:
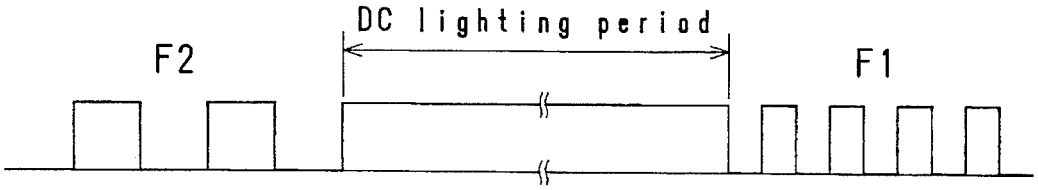
FIG. 9 is a diagram schematically showing a control signal when a DC lighting period is provided between the points before and after the activation of the discharge lamp.

To overcome such a shortcoming, it is desirable to provide a period for the DC lighting of the discharge lamp (hereinafter called "DC lighting period") between F2 and F1 as shown in FIG. 9 and not to change the lighting frequency from F2 to f1 directly, in order to ensure the lighting of the lamp. That is, the lighting control is performed in such a way that the discharge lamp undergoes DC lighting during the period where the lighting status of the discharge lamp is still unstable and the lighting frequency is changed to f1 after the DC lighting period passes.

Figure 10:
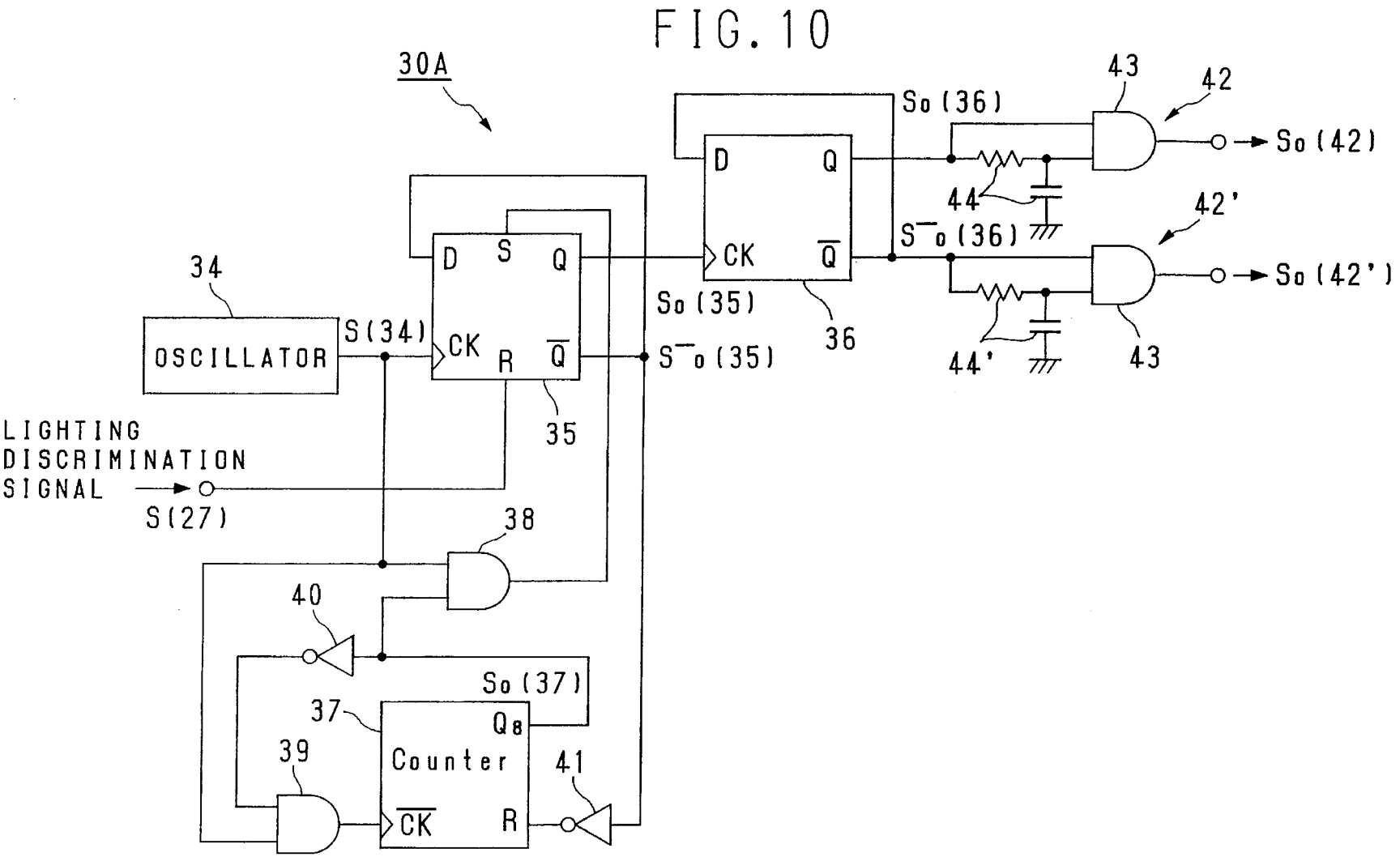
FIG. 10 is a circuit diagram exemplifying the structure of a lighting frequency controller for executing frequency control including DC lighting of the discharge lamp.

FIG. 10 exemplifies the structure of a lighting frequency controller 30A designed for such control.

The lighting frequency controller 30A includes an oscillator 34, flip-flops 35 and 36 and a counter 37.

The oscillator 34 produces a reference clock signal (having a reference frequency of "f3") and sends this signal to the clock input terminal (CK) of the flip-flop 35 and 2-input AND gates 38 and 39.

The flip-flop 35 is a set and reset type D flip-flop which receives the lighting discrimination signal at its reset terminal (R).

The counter 37 is a ripple carry counter having a clock input terminal (indicated by "CK" affixed above it with the bar indicating the negative edge trigger). The signal output from the output terminal (Q8) of a predetermined number of stages is inverted by a NOT gate 40, and the inverted signal is sent to the AND gate 39 which obtains the logical product of this signal and the reference clock signal. The resultant signal is supplied to the clock input terminall $\overline{CK}$ of the counter 37. The AND gate 38 obtains the logical product of the counter output from the output terminal Q8 of the counter 37 and the reference clock signal, and supplies the resultant signal to the set terminal (8) of the flip-flop 35.

The Q output signal of the flip-flop 35 is sent to the clock input terminal (CK) of the D flip-flop 36 at the subsequent stage, while the $\overline{Q}$ output signal of the flip-flop 35 is sent to the D input terminal of the flip-flop 35 directly and to the reset terminal (R) of the counter 37 via a NOT gate 41.

The D input terminal and the $\overline{Q}$ output terminal of the flip-flop 36 are connected together and the Q output signal and $\overline{Q}$ output signal are respectively sent to dead-time controllers 42 and 42'.

As both dead-time controllers 42 and 42' have the same structure, the structure of the dead-time controller 42 will be discussed below. The input signal is distributed to two directions, one of the thus distributed signal is input to one of the input terminals of a 2-input NAND gate 43 directly and the other to the other input terminal of the NAND gate 43 via an integrator 44, which comprises a resistor and a capacitor.

The components of the dead-time controller 42' which are identical to those of the dead-time controller 42 are given the same reference numerals but affixed with "'" and their descriptions will not be given.

Figure 11:
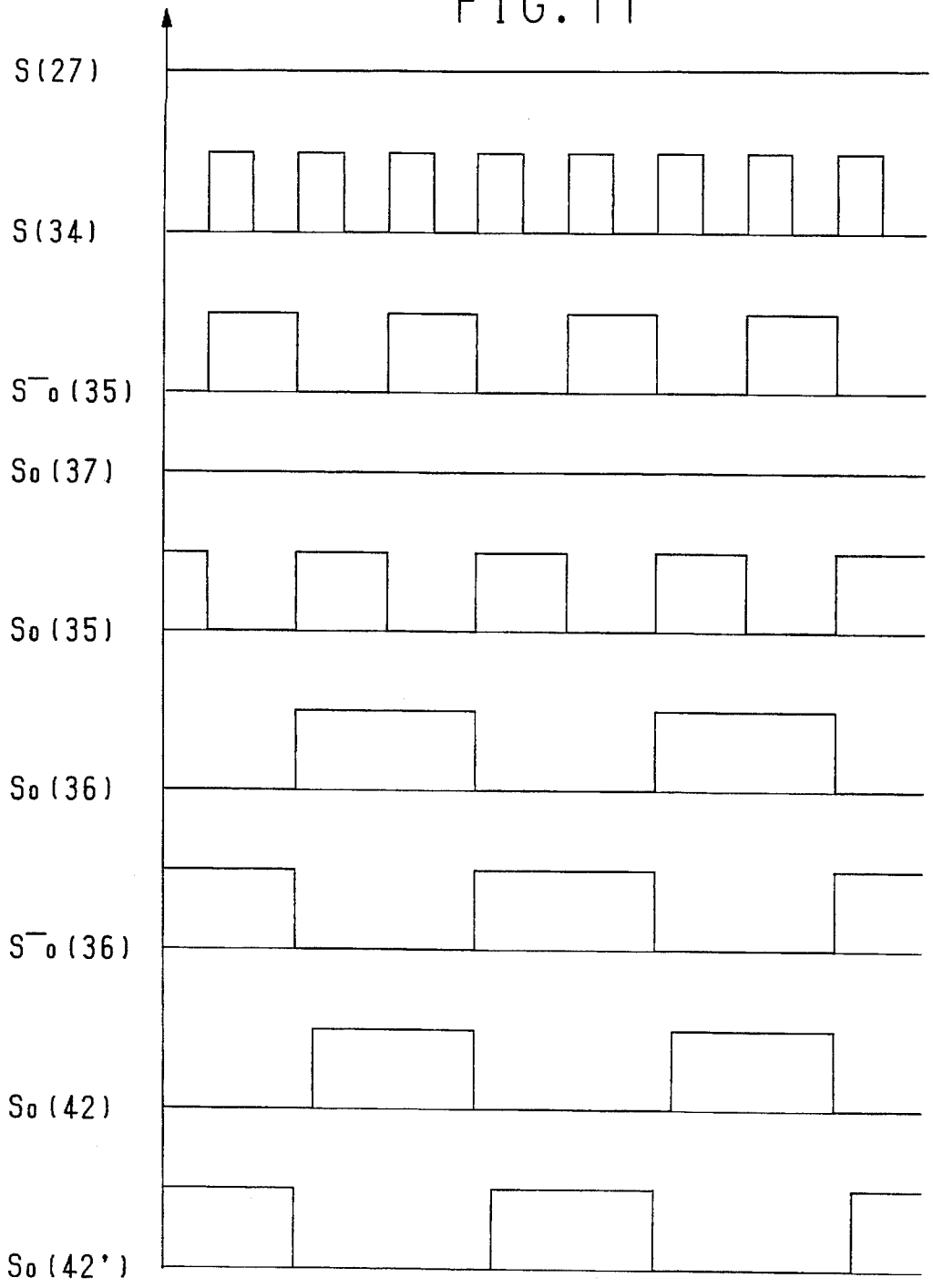
FIG. 11 is a time chart for explaining the operation of the lighting frequency controller in FIG. 10 before the lighting of the discharge lamp.
Figure 12:
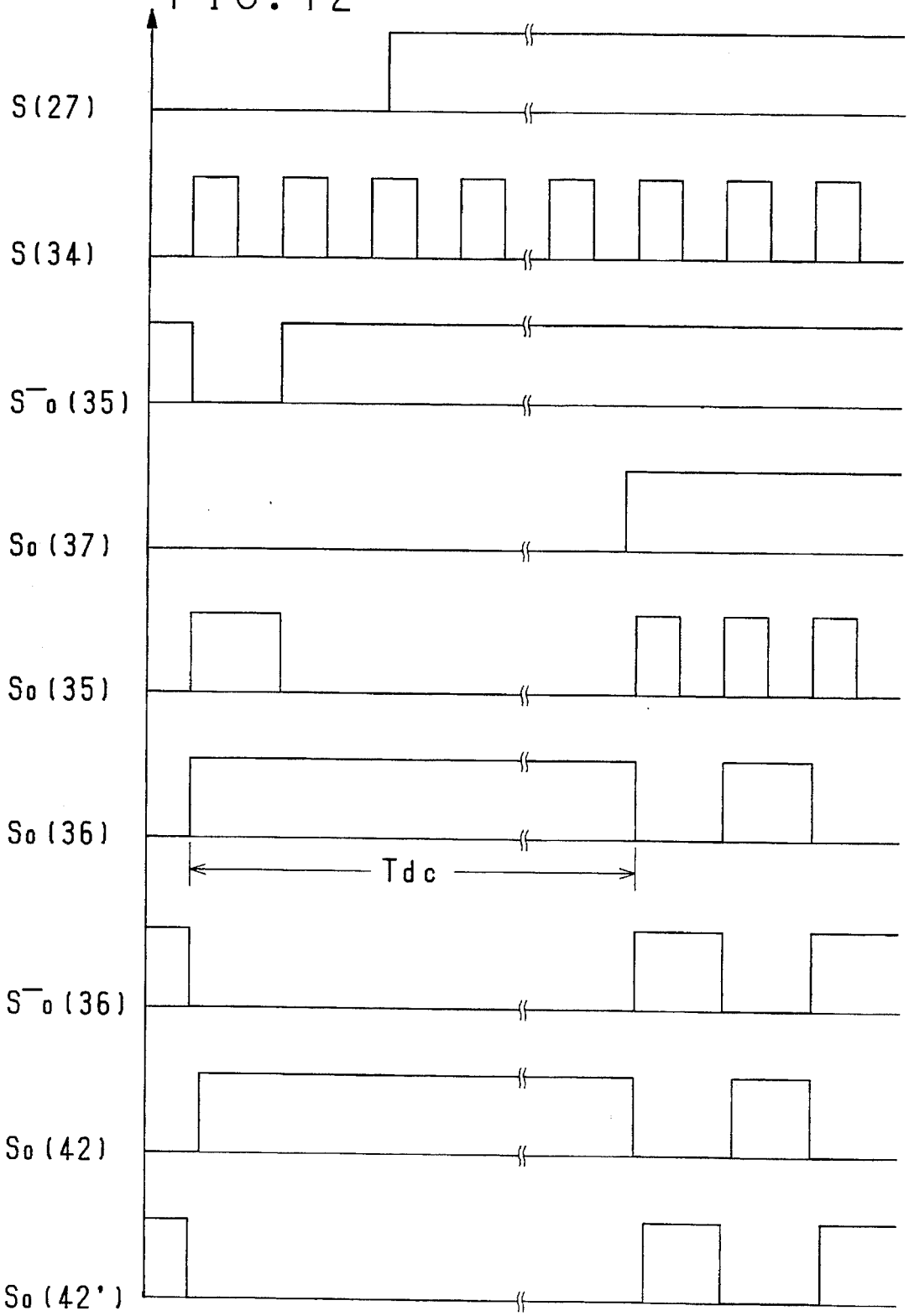
FIG. 12 is a time chart for explaining the operation of the lighting frequency controller in FIG. 10 immediately after the lighting of the discharge lamp.

FIGS. 11 and 12 are time charts for explaining the operation of the lighting frequency controller 30A. FIG. 11 shows signals at the individual sections of the lighting frequency controller 30A before the activation of the lamp, and FIG. 12 shows signals at the individual sections after the activation of the lamp.

In the diagrams, "S(34)" denotes a reference clock signal, "So(35)" denotes the $\overline{Q}$ output signal of the flip-flop 35, "So(37)" denotes the Q8 output signal of the counter 37, "So(35)" denotes the Q output signal of the flip-flop 35, "So(36)" denotes the Q output signal of the flip-flop 36, "S o(36)" denotes the, $\overline{Q}$ output signal of the flip-flop 36, "So(42)" denotes the output signal of the dead-time controller 42 and "So(42')" denotes the output signal of the dead-time controller 42'. As mentioned earlier, "So(27)" denotes the lighting discrimination signal.

Before the activation of the lamp, the lighting discrimination signal has an L level as shown in FIG. 11, so that the flip-flop 35 is not reset and the Q output signal So(35) of the flip-flop 35 is the reference clock signal frequency-divided by 2. This Q output signal So(35) is further frequency-divided by 2 by the flip-flop 36 at the subsequent stage. The reference frequency of this frequency-divided signal corresponds to the aforementioned frequency F2. During this period, the counter 37 is kept reset by the inverted signal of the $\overline{Q}$ output signal S(35), so that the output signal So(37) of the counter 37 has an L level, fixing the output signal of the AND gate 38 to an L level.

When the lamp is turned on, setting the lighting discrimination signal to an H level, as shown in FIG. 12 and this lighting discrimination signal is applied to the reset terminal of the flip-flop 35, the $\overline{Q}$ output signal So(35) of the flip-flop 35 is fixed to an H level. This releases the resetting of the counter 37, causing the counter 37 to start counting the reference clock signal. When the output signal So(37) of the counter 37 becomes an H level, its inverted signal is sent to the AND gate 39, disabling the counting operation of the counter 37. The output signal So(37) of the counter 37 is therefore fixed to an H level. Accordingly, the signal synchronous with the reference clock signal is supplied to the set terminal of the flip-flop 35 whose Q output signal So(35) has a rectangular waveform with the reference frequency f3. This Q output signal So(35) is frequency-divided by 2 by the flip-flop 36 at the subsequent stage. The reference frequency of the frequency-divided signal corresponds to the aforementioned F1.

The Q output signal of the flip-flop 36 becomes an H level over the period indicated by "Tdc" in FIG. 12. This period Tdc corresponds to the DC lighting period.

When the lighting of the lamp once activated fails in the DC lighting period, the lighting discrimination signal becomes an L level, resetting the flip-flop 35. When the Q output of the flip-flop 35 becomes an L level, the counter 37 is reset. The signals S(35) and So(35) do not have the opposite phases because of the specifications of the flip-flop 35.

The Q output signal and $\overline{Q}$ output signal of the flip-flop 36 are respectively sent to the dead-time controllers 42 and 42' which obtain the logical products of those signals and the delay signals. As a result, the rectangular wave signals are shaped to have dead times and the resultant signals are sent to the drive controller 7B of the DC-AC converter 7.

Figure 13:
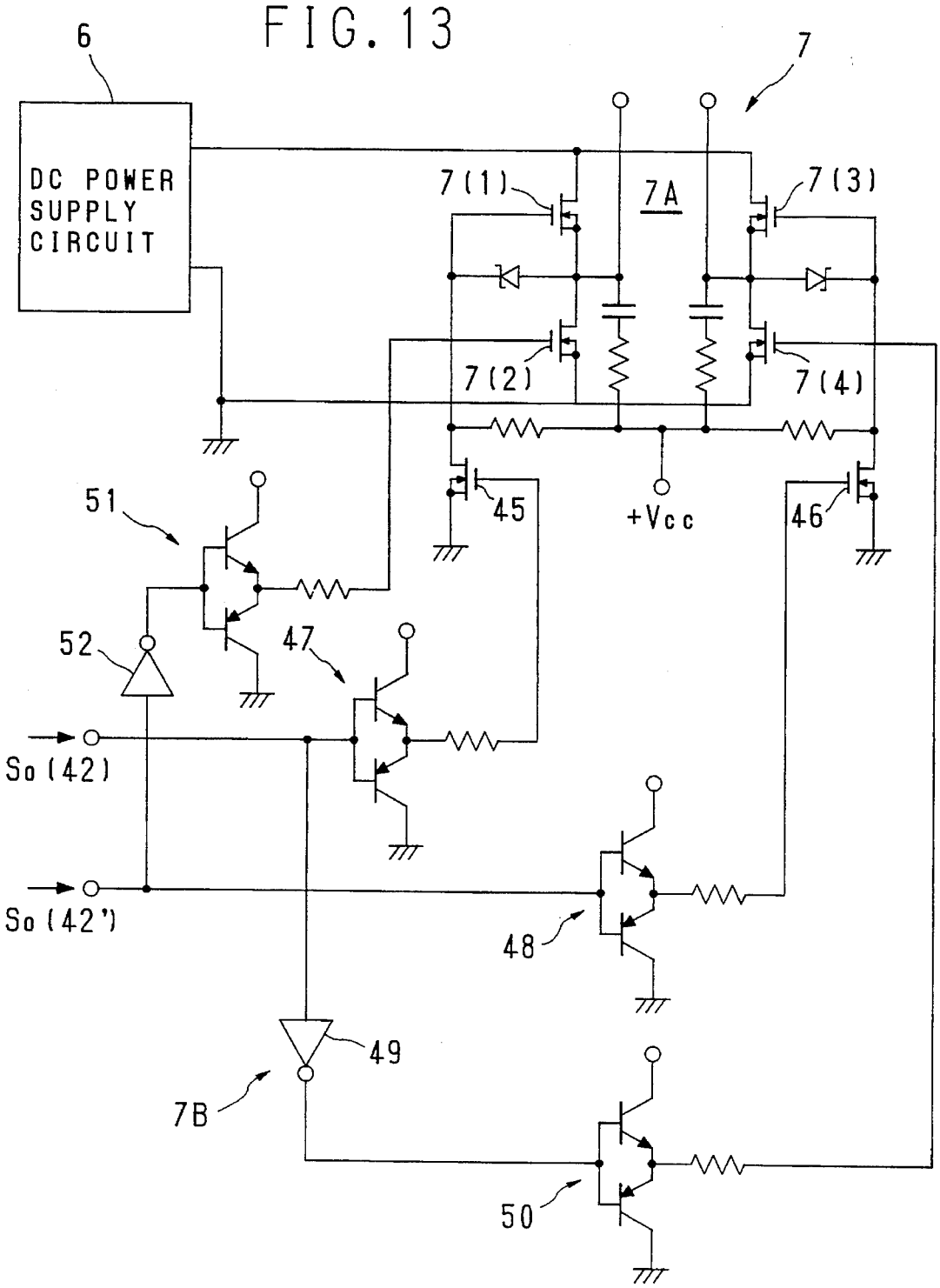
FIG. 13 is a circuit diagram exemplifying the structures of a bridge circuit and a drive controller.
Figure 14:
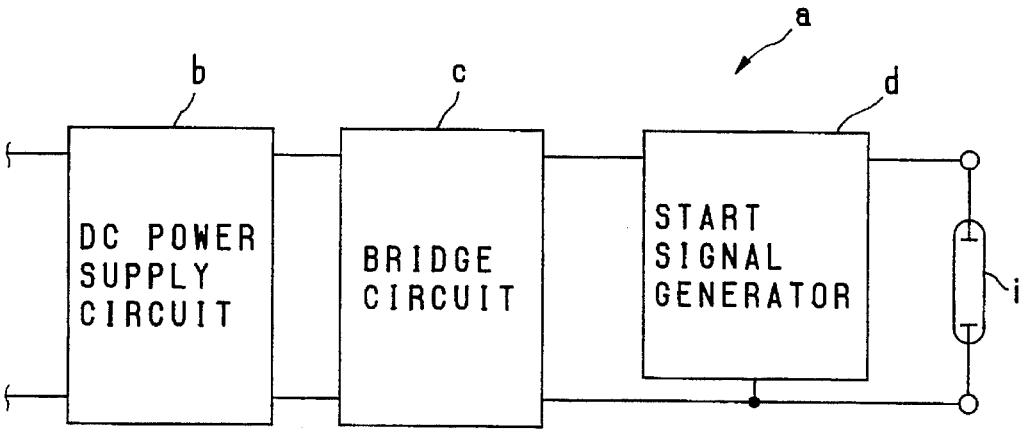
FIG. 14 PRIOR ART
FIG. 14 is a diagram showing the structure of a conventional lighting circuit.
Figure 15:
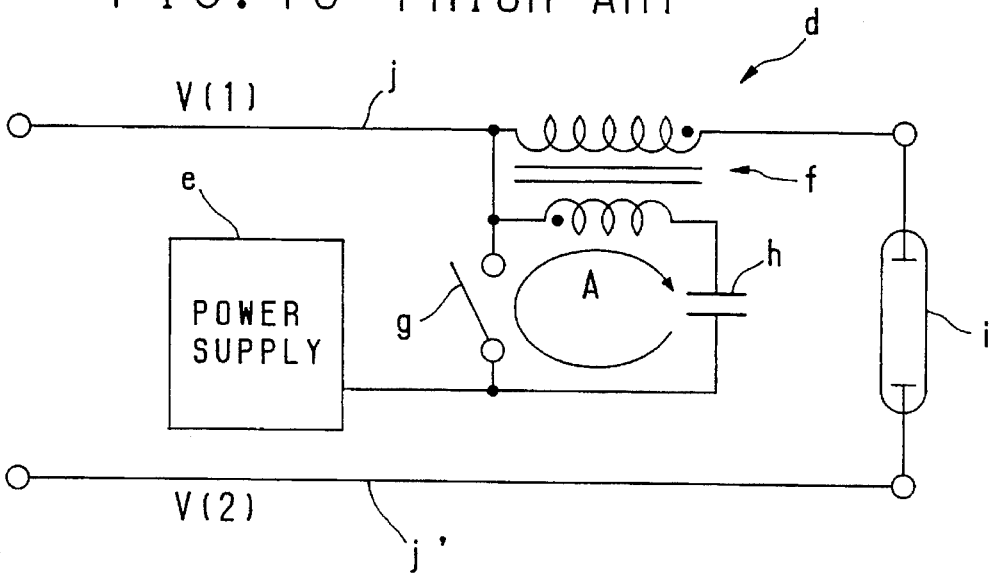
FIG. 15 PRIOR ART
FIG. 15 is a diagram showing an example of the structure of a conventional start pulse generator.
Figure 16:
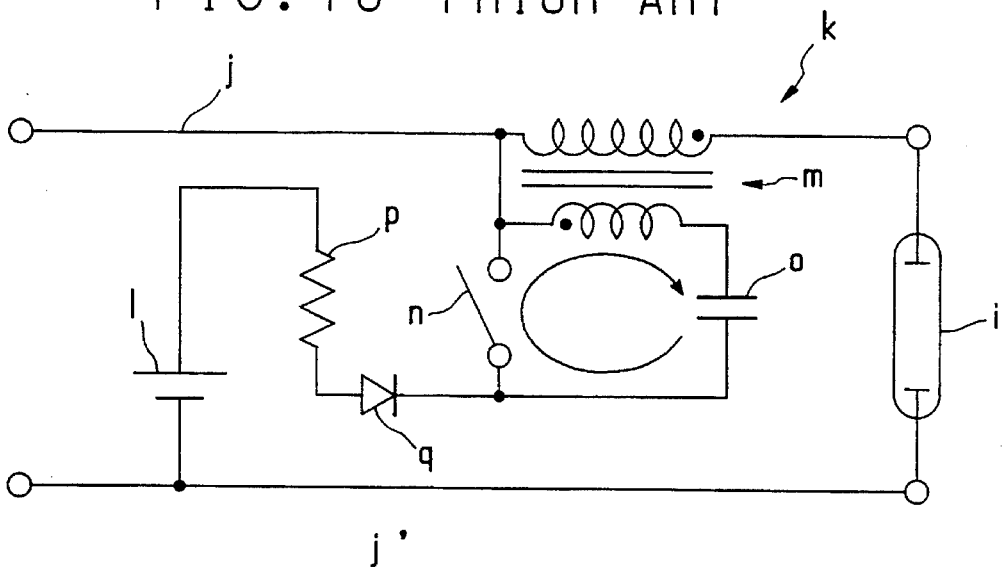
FIG. 16 PRIOR ART
FIG. 16 is a diagram showing an improved conventional start pulse generator.
Figure 17:
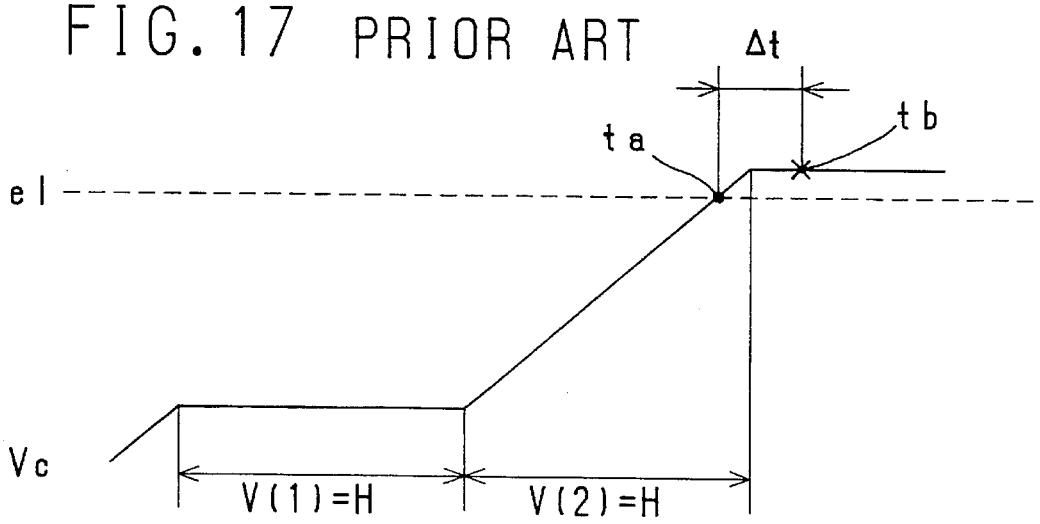
FIG. 17 PRIOR ART
FIG. 17 is a diagram for explaining the conventional problem.

The drive controller 7B has a structure as shown in FIG. 13, and has source-grounded N channel MOSFETs 45 and 46 provided for respectively controlling the semiconductor switch elements 7(1) and 7(3). The output signal So(42) of the dead-time controller 42 is supplied to the gate of the FET 45 via a complementary transistor pair 47. The output signal So(42') of the dead-time controller 42' is supplied to the gate of the FET 46 via a complementary transistor pair 48.

The output signal So(42) of the dead-time controller 42 is inverted by a NOT gate 49 and is supplied as a control signal to the semiconductor switch element 7(4) via a complementary transistor pair 50. The output signal So(42') of the dead-time controller 42' is inverted by a NOT gate 52 and is supplied as a control signal to the semiconductor switch element 7(2) via a complementary transistor pair 51.

Accordingly, the switching operations of the pair of the semiconductor switch elements 7(1) and 7(3) and the pair of the semiconductor switch elements 7(2) and 7(4) are almost reciprocally controlled with predetermined dead times. Since So(42) is an H-level signal and So(42') is an L-level signal during the DC lighting period, the semiconductor switch elements 7(1) and 7(4) are set off and the semiconductor switch elements 7(2) and 7(3) are set on, so that the output of the DC power supply circuit 6 is directly supplied to the metal halide lamp 10.

According to the lighting circuit for a vehicular discharge lamp embodying the present invention, as described above, the ON status or the OFF status of the discharge lamp is discriminated, and the lighting frequency is changed in such a manner that the frequency of the rectangular wave output from the DC-AC converter before the activation of the discharge lamp becomes lower than the frequency of the rectangular wave after the activation of the discharge lamp. This reduces the frequency of occurrence of mismatching between the generation timing for the start pulse and the phase of the rectangular wave caused by the delayed yielding of the self-breakdown switch element.

If the DC lighting of the discharge lamp is intervened in the period of the transition from the OFF status of the discharge lamp to the ON status thereof, the lighting performance of the discharge lamp can surely be improved.

The specific circuit structures described in the foregoing description of this embodiment are to be considered as illustrative and not restrictive and the technical scope of the invention is not to be limited to the details given herein. For instance, although the ratio of the lighting frequency before the activation of the discharge lamp to the lighting frequency after the activation of the discharge lamp is set to 1:2, it may be set to an arbitrary ratio (1:N). Therefore, the present invention may be modified in many other forms without departing from the scope and spirit of the invention.

What is claimed is:

1. A lighting circuit for a vehicular discharge lamp, comprising:

a DC-AC converter for converting a DC voltage from a DC power supply circuit to an AC voltage with a rectangular waveform and supplying said AC voltage to a discharge lamp;

a start pulse generator for generating a start pulse to said discharge lamp, superimposing said start pulse on an output of said DC-AC converter and supplying a resultant pulse to said discharge lamp, said start pulse generator including a transformer having a secondary winding connected to a power supply line connecting an output terminal of said DC-AC converter to said discharge lamp and a primary winding to which a capacitor and a self-breakdown switch element are connected in series, whereby a timing at which said start pulse is generated by closing of the series circuit of said self-breakdown switch element, said primary winding and said capacitor, caused when said self-breakdown switch element yields, is associated with a specific phase of said rectangular wave from said DC-AC converter;

a lighting discriminating circuit for discriminating an ON status or OFF status of said discharge lamp; and lighting frequency control means for changing a frequency of said rectangular wave from said DC-AC converter in such a manner that a frequency of said rectangular wave output from said DC-AC converter at a time said OFF status of said discharge lamp is discriminated by said lighting discriminating circuit becomes lower than a frequency of said rectangular wave at a time said ON status of said discharge lamp is discriminated by said lighting discriminating circuit.

2. The lighting circuit according to claim 1, wherein said lighting frequency control means performs frequency control in such a way that DC lighting of said discharge lamp is carried out over a predetermined period in a period of transition from said OFF status of said discharge lamp to said ON status thereof.

3. The lighting circuit according to claim 1, further comprising a voltage detecting section, provided between terminals of said DC power supply circuit, for detecting an output voltage of said DC power supply circuit, and a current detecting section, inserted in a ground line connecting said DC power supply circuit to said DC-AC converter, for detecting an output current of said DC power supply circuit.

4. The lighting circuit according to claims 1 or 3, wherein said start pulse generator further includes a constant power source for charging said capacitor.

5. The lighting circuit according to claim 4, wherein said constant power supply is accomplished by designing said DC power supply circuit to have a structure of a flyback type DC-DC converter comprising a transformer with a start winding provided on a secondary winding side of said transformer and a rectifier, connected to said start winding, for rectifying an output of said start winding, thus yielding a constant voltage.

6. The lighting circuit according to claim 4, wherein said constant power supply is accomplished by a voltage doubler rectifier circuit, comprising diodes, capacitors and resistors, provided between said power supply line and a second power supply line connecting a second output terminal of said DC-AC converter to said discharge lamp, thus yielding a constant voltage.

7. The lighting circuit according to claim 3, wherein said light discriminating circuit discriminates said ON status or said OFF status of said discharge lamp depending on whether said output current of said DC power supply circuit, detected by said current detecting section, is equal to or greater than a predetermined reference value.

8. The lighting circuit according to claim 7, wherein said light discriminating circuit includes an amplifier for amplifying a terminal voltage of said current detecting section and a comparator for comparing an output of said amplifier with a reference voltage, whereby said light discriminating circuit discriminates that said discharge lamp is in said ON status and outputs a lighting discrimination signal having a first predetermined level when said output of said amplifier is greater than said reference voltage, and discriminates that said discharge lamp is in said OFF status and outputs a lighting discrimination signal having a second predetermined level when said output of said amplifier is equal to or smaller than said reference voltage.

9. The lighting circuit according to claims 1 or 2, wherein said lighting frequency control means includes an oscillator for producing a reference clock signal and a flip-flop having a clock input terminal for receiving said reference clock signal from said oscillator, a set terminal for receiving said reference clock signal from said oscillator and a lighting discrimination signal via an AND gate, and a reset terminal for receiving said lighting discrimination signal.

10. The lighting circuit according to claims 1 or 2, wherein said DC-AC converter includes a bridge circuit having semiconductor switch elements, and a drive controller for controlling driving of said semiconductor switch elements.

11. The lighting circuit according to claim 10, wherein said drive controller has source-grounded N channel MOSFETs provided for respectively controlling a pair of semiconductor switch elements among said semiconductor switch elements.

12. The lighting circuit according to claims 10 or 11, wherein said lighting frequency control means includes an oscillator for producing a reference clock signal, a first flip-flop for receiving said reference clock signal, a second flip-flop connected to said first flip-flop, a counter 37 for counting said reference clock signal from said oscillator, said first flip-flop being reset by a lighting discrimination signal output from said light discriminating circuit, a first dead-time controller for obtaining a logical product of a first output signal of said first flip-flop and a first delay signal, and a second dead-time controller for obtaining a logical product of a second output signal of said second flip-flop and a second delay signal, whereby said rectangular wave output of said DC-AC converter is shaped to have a dead time and resultant signals are sent to said drive controller of said DC-AC converter.

13. The lighting circuit according to claim 12, wherein said first flip-flop is a set and reset type D flip-flop for receiving said lighting discrimination signal at a reset terminal and receiving a set signal at a set terminal.

14. The lighting circuit according to claim 13, wherein said counter is a ripple carry counter having a clock input terminal for receiving a clock signal via a first AND gate and an output terminal whose output is inverted by a NOT gate, said first AND gate for obtaining a logical product of said inverted signal from said NOT gate and said reference clock signal from said oscillator and outputting a resultant signal to said clock input terminal of said counter, said output from said output terminal of said counter being also supplied to a second AND gate for obtaining a logical product of said receiving output from said output terminal of said counter and said reference clock signal from said oscillator and for outputting a resultant signal to said set terminal of said first flip-flop.

* * * * *